United States Patent [19]

Wiebe

[11] Patent Number: 4,953,374

[45] Date of Patent: Sep. 4, 1990

[54] SECURE LOCKING MECHANISM

[76] Inventor: Jacob R. Wiebe, 60 Heaton Avenue, Winnipeg, Manitoba, Canada, R3B 3E3

[21] Appl. No.: 419,008

[22] Filed: Oct. 10, 1989

Related U.S. Application Data

[60] Continuation of Ser. No. 126,899, Nov. 30, 1987, abandoned, which is a division of Ser. No. 944,746, Dec. 22, 1986, Pat. No. 4,732,317.

[51] Int. Cl.[5] ..... E05B 17/00

[52] U.S. Cl. ..... 70/416; 70/455; 70/158; 109/52

[58] Field of Search ..... 70/57, 58, 63, 158, 70/163–173, 416–420, 423, 455, 454, DIG. 41, 230–232; 109/51, 52

[56] References Cited

U.S. PATENT DOCUMENTS

| | | | |
|---|---|---|---|
| Re. 29,146 | 3/1977 | Wimpffen | 70/170 |
| 1,020,208 | 3/1912 | Laughlin | 70/454 X |
| 1,043,033 | 10/1912 | Rowse | 70/DIG. 41 X |
| 1,366,804 | 1/1921 | Jackson | 70/455 X |
| 2,076,004 | 4/1937 | Ringseis | 70/454 |
| 2,080,038 | 5/1937 | Frederickson | 109/52 |
| 2,733,590 | 2/1956 | Crumb | 70/455 X |
| 2,877,637 | 3/1959 | Greenwald | 70/168 X |
| 3,045,400 | 7/1962 | Grose | 109/52 X |
| 3,064,086 | 11/1962 | Sedley | 70/57 X |
| 3,128,618 | 4/1964 | De Vines | 70/420 X |
| 3,142,168 | 7/1964 | Wellekens | 70/416 |
| 3,263,463 | 8/1966 | Duval et al. | 70/455 |
| 3,343,386 | 9/1967 | Hall | 70/454 X |
| 3,910,079 | 10/1975 | Gassaway | 70/232 X |
| 3,978,698 | 9/1976 | Ono | 70/232 X |
| 3,995,459 | 12/1976 | Weeks et al. | 70/232 X |
| 4,037,780 | 7/1977 | Brownlee | 70/63 X |
| 4,052,869 | 10/1977 | Weber | 70/455 X |
| 4,156,501 | 5/1979 | Greenwald et al. | 70/168 X |
| 4,296,617 | 10/1981 | Campagna | 70/63 |
| 4,346,940 | 8/1982 | Tatar | 70/231 X |
| 4,362,035 | 12/1982 | Vitale | 70/231 X |
| 4,406,140 | 9/1983 | Wolter | 70/231 |
| 4,490,998 | 1/1985 | Wellekens | 70/419 |
| 4,493,268 | 1/1985 | Sidler | 70/63 X |
| 4,532,783 | 8/1985 | Maurice | 70/63 |
| 4,577,477 | 3/1986 | Olshausen | 70/58 |
| 4,616,776 | 10/1986 | Blumenthal | 109/52 X |
| 4,638,652 | 1/1987 | Morse et al. | 70/454 |
| 4,683,734 | 8/1987 | Peterson | 70/171 X |
| 4,718,259 | 1/1988 | Appelbaum | 70/63 |
| 4,731,819 | 3/1988 | Kalfon | 109/52 X |

FOREIGN PATENT DOCUMENTS

| | | | |
|---|---|---|---|
| 1037915 | 8/1958 | Fed. Rep. of Germany | 70/454 |
| 1118050 | 11/1961 | Fed. Rep. of Germany | 70/455 |
| 1118649 | 11/1961 | Fed. Rep. of Germany | 70/455 |
| 1164270 | 2/1964 | Fed. Rep. of Germany | 70/455 |
| 2065758 | 7/1981 | United Kingdom | 70/455 |

*Primary Examiner*—Gary L. Smith
*Assistant Examiner*—Suzanne L. Dino
*Attorney, Agent, or Firm*—Adrian D. Battison; Stanley G. Ade; Murray E. Thrift

[57] ABSTRACT

A security container comprises two halves which can be slid together longitudinally to close the container and locked in the longitudinally closed position. Each half comprises a channel member and an associated end cap which is of a size to cover the whole of the end of the container. Edges of the side panels of each channel member include u-shape formations to that the two halves interlock for a longitudinal movement. A money compartment is defined in the bottom of the rear half by a transverse plate parallel to the lower end cap. A drawer is mounted in the compartment and can be locked by rotating a threaded rod into engagement with a nut welded on the rear face of the rear channel member. A locking mechanism for the above container includes a protective cover including two plates covering the front face of the lock barrel with four balls between the plates allowing a key to pan between the balls into the lock but resisting a punch force to the front of the lock.

9 Claims, 5 Drawing Sheets

SECURE LOCKING MECHANISM

This application is a continuation of application, Ser. No. 126,899, filed Nov. 30th, 1987 (now abandoned) which was a Divisional application of application, Ser. No. 944,746, filed Dec. 22nd, 1986 and now issued as U.S. Pat. No. 4,732,317 and dated Mar. 22nd, 1988.

BACKGROUND OF THE INVENTION

This invention relates to a secure locking mechanism particularly but not exclusively for a housing of a coin freed mechanism.

Coin freed devices are used to operate various different types of equipment. In some cases such as vending machines the machines are often placed in a location which enables them to be watched over by responsible persons to reduce the likelihood of attempts to break open and steal the contents. In such cases it is desirable to provide a suitable locking arrangement and security container but in many cases these are not particularly complex or strong since the positioning of the equipment tends to inhibit attempts of theft.

In other cases such as car wash equipment, the coin freed devices are located in an area which is generally not supervised and hence the container for the coin freed device must be manufactured in a manner which itself inhibits attempts at theft.

One problem which arises with devices of this type, and also with other locked devices is that of attempts to force the lock by pounding it centrally with a punch to force the lock barrel out of its seating.

It is one object of the invention therefore to provide a lock guard device which can be used to protect a key operated lock against unauthorized forcing of the lock.

According to the invention there is provided a lock mechanism comprising a lock actuating device, a lock member engageable by an elongate blade of a key, said lock member having a [slot shaped] slot-shaped front opening for movement along an axis into the lock member of the blade of the key when pressed through said front opening, said key blade being shaped to have one dimension transverse to its length longer than s dimension at right angles thereto so that it can pass through the slot-shaped front opening, said member and key being arranged such that a matching key can be rotated to move the lock actuating device, and a security cover device for covering the front opening, said security cover device comprising a collar member for surrounding said front opening and defining a cover opening forward of and axially aligned wit said front opening a cylindrical wall extending from said cover opening to said front opening, and lip means on said cylindrical wall at said cover opening, said cylindrical wall having a circular cylindrical inner surface surrounding said axis, a front plate member received within the cylindrical wall generally at right angles to the axis and free to rotate within the cylindrical wall about the axis, said front plate member having a slot-shaped opening therein for the key, said lip means confining the plate member within the cylindrical wall against axial movement out of the cover device, and at least three rigid spherical balls separately and freely mounted in an area defined rearwardly of the front plate and inwardly of the cylindrical wall, the balls being free to move radially within the confines of the cylindrical wall and to rotate around said axis, the balls being dimensioned relative to the cylindrical wall such that, when the balls are moved in an outward direction to a parted position sufficient to just allow the blade of the key to pass through a slot shaped opening closely defined between the balls, the balls are restrained from further movement in the outward direction by contacting the cylindrical wall.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Basically the container is of a very simple construction comprising a rear channel member 10 to which is welded a lower end cap 11 and a front channel member 12 to which is welded an upper end cap 13. Thus basically there are two parts which can be assembled into the position shown in FIG. 1 defining a fully closed container and can be moved into the position shown in FIG. 2 in which the container is opened for ready access to both of the parts and the devices on the interior thereof.

Figure 3:
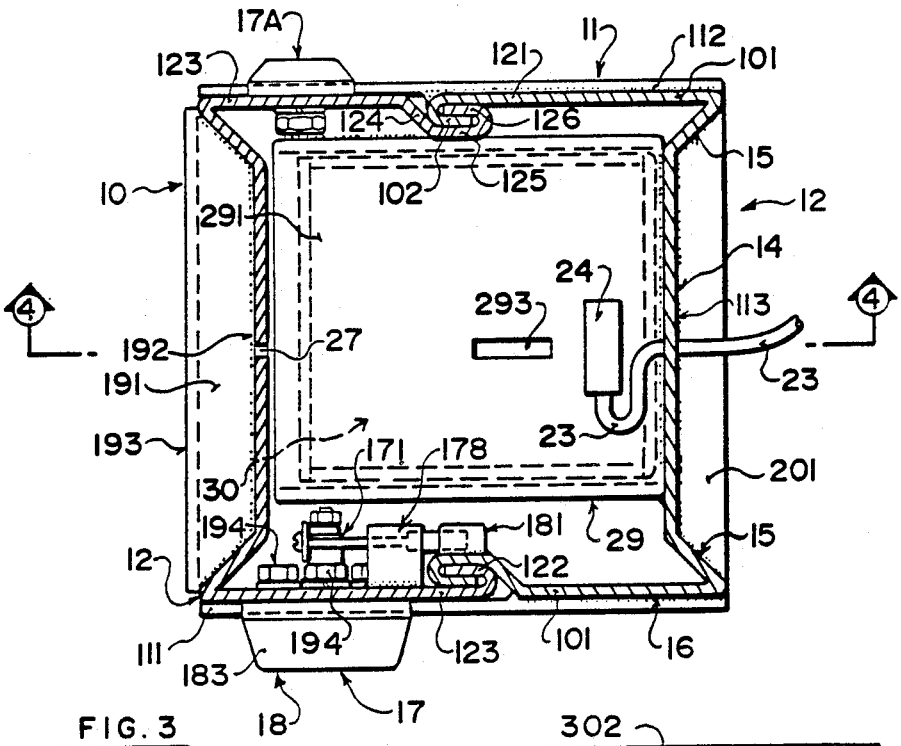
FIG. 3 is a cross-sectional view of the container taken in a horizontal plane approximately at the mid-height of the container of FIG. 1.

Turning firstly therefore to the details of the channel members, this is best shown in FIG. 3. Each of the channel members comprises a base panel 14 which is a substantially vertical planar surface and which is bent at approximately 60 degrees at both vertical edges as indicated at 15. The inclined panels so formed at 15 join with side panels 16 of the channel member at a v-shape with the side panels extending generally at right angles to the base panel 14.

Longitudinal edges of the side panels 16 remote from the base panel 14 include interlocking devices for locking the side panels of one channel member to the side panels of the other channel member. The interlocking devices are formed simply by u-shaped portions turned back as shown. Specifically the side wall 121 of the channel member 12 and also the side wall 123 of the channel member 10 have at their upper edge a turned back portion 122, 102 which thus defines a u-shape with the inside of the u facing back toward the respective base panel and an outer rounded face of the u facing toward the side wall of the opposite channel member. The spacing between the turned back portion 122 and the side wall 121 is slightly greater than, for clearance purposes, the thickness of the side wall material.

The opposed side wall 101 of the channel member 12 is identical in construction to the opposed side wall 123 of the channel member 10. Thus the side wall 123 is bent first inwardly as shown at 124 and then in a direction parallel to the side wall 123 as indicated at 125 so that the portion 124 defines an offset. At the outer edge of the parallel portion 125, the edge is turned back to define a u-shape having as one leg the portion 125 and an opposed leg a portion 126 which is parallel thereto and spaced therefrom by a distance slightly greater than the wall thickness.

Thus close inspection of the interlocking between the side panel 101 and the side 123 will show that the u-shapes simply interlock to prevent movement of the channel members in a direction to increase the spacing of the base panels. In addition the offset 124 engages the outer face of the base of the u formed by the turned back portion 102 so as to prevent movement of the side panels in a direction to decrease the spacing between the base panels. In addition the offset 124 allows the side panels 101 and 123 to lie in the same plane. The whole of the interlocking arrangement is on the inner face of the side panels so that the only visible sign of the interconnection comprises a v-shaped slot in the outer surface which can be seen in FIG. 1.

Each of the end caps 11 and 13 comprises effectively a flat planar surface of a size to cover the whole of the end face of the enclosure. In addition the end caps include flanges 111, 112 which are turned at right angles to the base surface so as to extend upwardly along the sides of the channel members.

The lower end cap 11 is welded to the rear channel member 10 along weld lines on the exterior surface visible along the side at 112 and along the lower edge of the base panel as indicated at 113 in FIG. 3. The upper end cap 13 is welded to the front channel member along sides indicated at 114 and along the junction thereof with the base panel as indicated at 115.

The channel members can be locked against longitudinal movement by a locking assembly 17 mounted on the housing at the side panel. Thus the locking assembly 17 is mounted on the side panel 123 and comprises a lock barrel 171 of conventional form which includes a front plate 172 with a slot 173 for receiving a plate shaped key again of conventional form. The key thus has a blade which can be inserted into the barrel with a blade being elongate and having a transverse dimension which is substantially slot shaped. The front face of the barrel 172 comprises a head which can be presented on an outer surface of the wall 123 with the barrel extending through an opening in that wall so that the barrel is prevented from axial movement relative to the wall. A washer or nut 174 is mounted on the barrel at the rear face of the wall 123. The barrel carries a cam 175 on a rear end thereof which can engage against an end plate 176 of a bar 177 to move that bar out of locking engagement. The bar is moveable within a cylinder 178 and is spring biased by a spring 179 in a locking direction so that an outer most end 180 of the bar which is formed of a hardened steel material can engage underneath a stop 181 welded to unit portion indicated at 127 of the wall 123.

The stop 181 has a ramp 182 on an upper side thereof for cooperating with the bar 177 so that sliding movement of the two portions of the housing into a closed position causes the lock mechanism to retract and then snap back into the lock position under the bias of the spring 179.

The strength of the locking action is provided between the stop 181 and the end 180 of the bar 177 both of which can be formed from a hard material and is therefore independent of the strength of the cam or the end plate of the barrel mechanism.

Attached to the outer face of the wall 101 is a lock guard assembly which is defined by a collar 183 which surrounds the endface 172 of the barrel of the lock. The collar defines an inner cylinder 184 which has an open end 185 facing axially of the barrel so that the key can be inserted in the axial direction through the cylinder 184 of the collar 183 into the barrel.

Within the cylinder 184 is positioned a first plate member 186 which is circular and of a size substantially equal to the inner circular circumference of the cylinder 184 so that it can rotate within the cylinder. The plate 186 is held in position in the cylinder by a lip 187 which surrounds the opening 185 and is of an internal diameter slightly less than the outside diameter of the plate 186. A slot shaped opening 188 is positioned within the plate 186 so the blade of the key can pass through. A second plate 189 is positioned adjacent the front face 172 and similarly is of circular cross section and has a slot 190. The slots thus can be aligned by movement of the blade of the key and then aligned with the slot 173 in the front face 172 so that the key can enter the barrel to carry out its actuation function.

Figure 8:
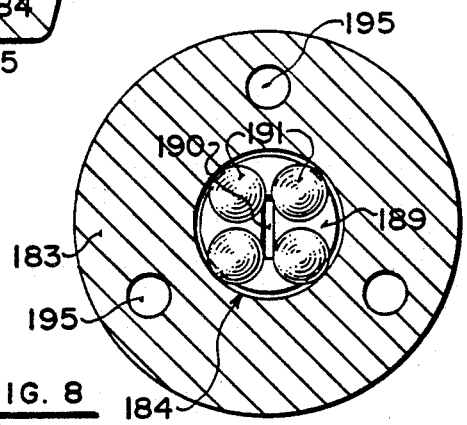
FIG. 8 is a cross sectional view along the lines 8—8 of the lock mechanism of FIG. 6.

Between the plates 189 and 186 is provided a plurality of balls 191 of hardened material for example steel. In the preferred arrangement thereof four such balls of equal diameter are arranged such that they are together a loose fit within the cylinder but such that the dimensions of the balls themselves in the cylinder are such that the balls are retained in their arrangement peripherally of the cylinder but are loose for rotation about their axis and full rotation about the cylinder. The balls are however, a loose fit so that the key when inserted can define a slot shape between the balls by moving, as shown in FIG. 8, the upper two balls slightly apart and also the lower two balls slightly apart so the key can pass through that slot shaped opening to the slot in the rear plate and to the barrel.

Thus the lock guard does not in any way interfere with the operation of the key in its normal manner except that the blade of the key requires to be of increased length to accommodate the axial length of the lock guard.

However the lock guard prevents or inhibits unauthorized action upon the barrel. Specifically, two preferred modes of attempting to break into a lock are prevented or inhibited In a first mode, a drill is positioned against the exterior surface of the lock so as to drill out the lock and allow access to the interior. This is prevented by the fact that the plate 186 is free to rotate on the balls and thus any drilling action will be prevented since the drill will not be rotating against the part in which it is engaging. A second preferred action of intended break in is by way of applying a punch against the outer surface of the lock so as to punch out the barrel in an axial direction. In this case a punch would normally be applied against the plate 186 and thus enter the area between the balls 191.

This action acts to force the balls outwardly, which movement is supplemented by the material from the plate 186 which is forced into that area between the balls. Any force applied by the punch is therefore applied on an inner side of the ball in a direction diverging outwardly from the axis of the lock toward the outer edges of the face 172 of the lock so that the face is forced against the wall 101. Thus the force from the punches prevent it from acting directly axially but is instead directed partly radially so a to significantly reduce the effect of the punch.

The collar 183 includes a first cylindrical portion 192 and an outer tapered portion 193. The latter prevents or reduces the possibility of a pipe wrench being applied to the device to attempt to remove it from the wall 101. The collar 183 is bolted to the wall 101 by bolts 194 which pass through openings in the wall 101 into blind holes 195 which are screw threaded within the collar 183.

An underside of the collar 183 at the portion 192 is cut away so that it defines a lip which extends over the flange 111 when the front portion of the housing is moved down into its closed position. This lip inhibits the possibility of a leverage tool being inserted between the flange 111 and the upstanding wall 101.

Figure 1:
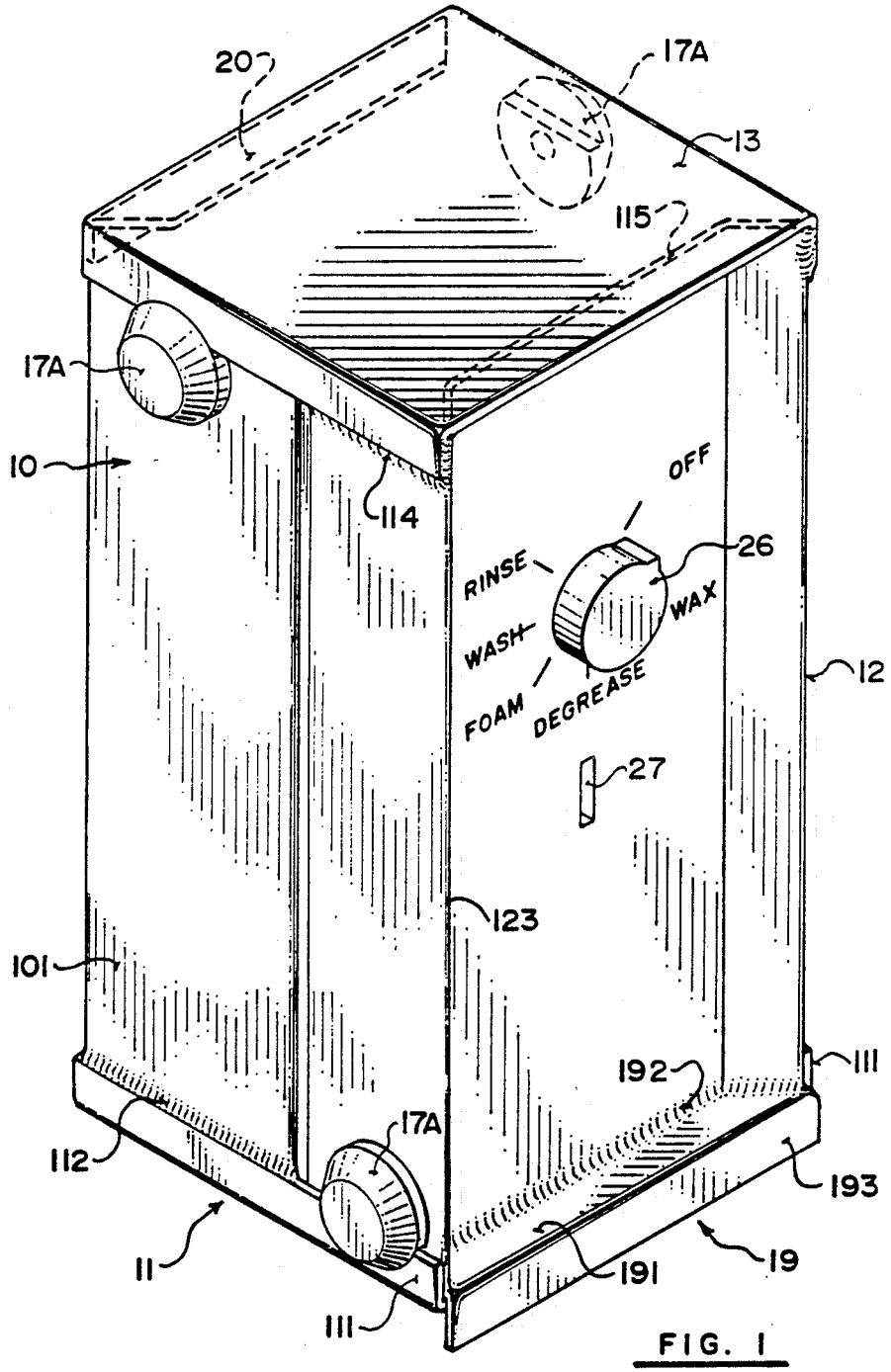
FIG. 1 is an isometric view of a secure container according to the invention particularly for containing a coin freed mechanism for use in a car wash device.

Similar shaped bodies 17A to the collar 183 are positioned at the opposed symmetrical positions of the housing so as to prevent similar leverage action at the other flanges both at the upper edge and at the lower edge of the housings as best shown in FIGS. 1 and 3.

The front channel member carries a lower lip member 19 and the rear channel member carries an upper lip member 20. The lower lip member 19 comprises a horizontal plate 191 which is arranged to sit on the lower end cap when the front channel member is lowered to its lower most position. The rear edge of the plate 191 is welded as indicated at 192 to the lower edge of the base panel of the front channel member. A front edge of the plate 191 is bent at right angles downwardly as indicated at 193 so as to extend over a front edge of the lower end cap and extend downwardly therefrom to prevent a potential thief from attempting to insert a leverage tool between the lower edge of the front channel member and the upper surface of the lower end cap.

Figure 2:
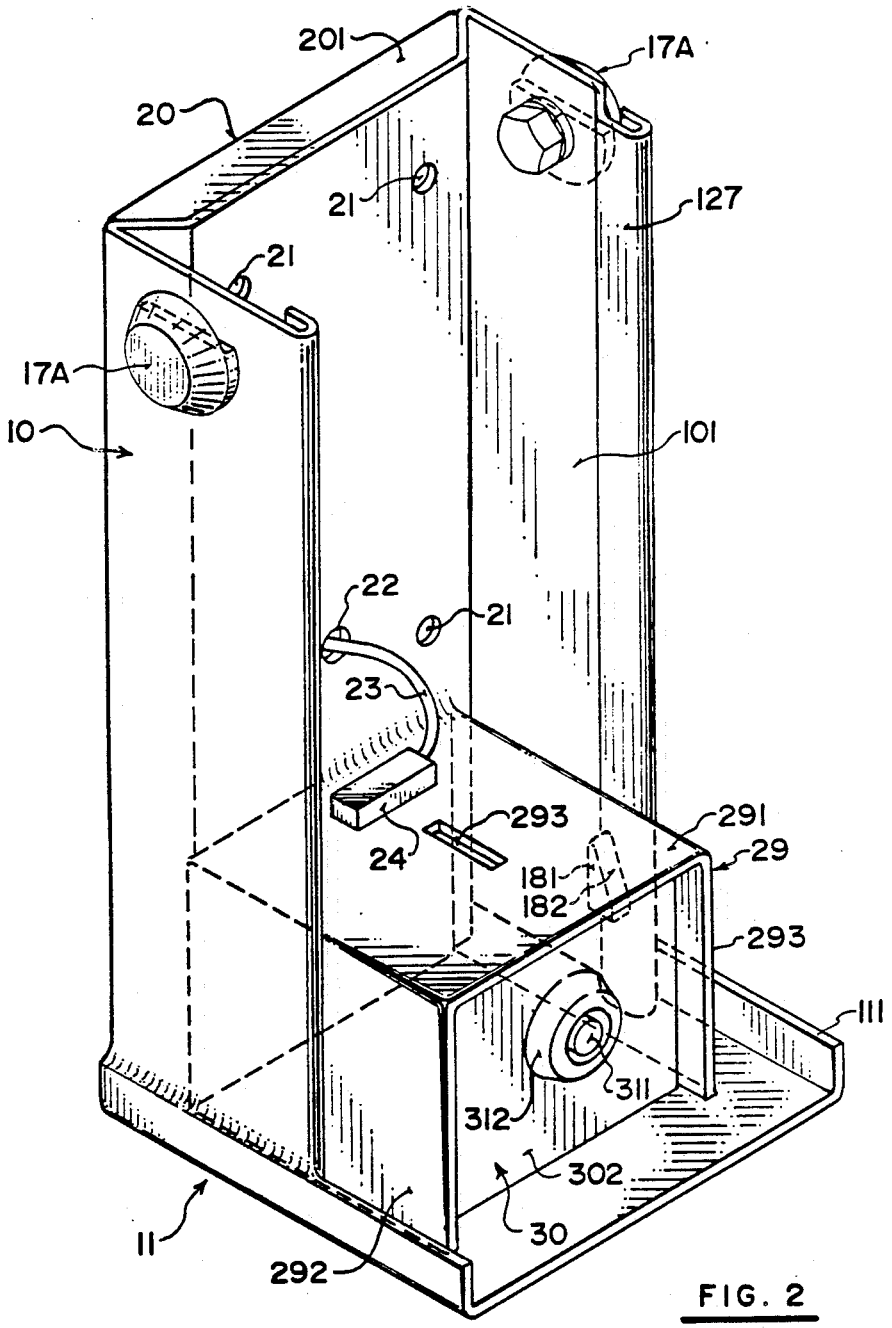
FIG. 2 is an isometric view similar to FIG. 1 with the front channel member including the upper end cap attached thereto removed to show the interior thereof and with the lock omitted for convenience of illustration.

The upper lip member 20 is attached to the rear channel member as shown best in FIG. 2 and comprises a horizontal plate portion 201 which is welded to the upper edge of the base panel of the rear channel member. In addition a downwardly extending lip 202 is formed by a bent rear edge portion of the plate 201. The function of the lip member 20 is firstly to provide a similar thickness to that of the lower lip member 19 so that, with the channel members 10 and 12 of identical length, the channel members sit equally on the respective end caps. In addition the lip 202 causes a slight forward inclination of the rear channel member when it is attached to a flat surface so that the upper end cap can be removed by movement in an upward and very slightly forward direction to prevent it binding on the flat surface which might occur if the movement were directly vertical.

The rear channel member can thus be attached to a suitable flat surface by way of bolts or screws passing through holes 21 in the base panel. A further hole 22 in the base panel allows the entry of an electrical supply cable 23 for operation of actuation equipment within the housing as explained hereinafter. The cable 23 as shown best in FIG. 2 is attached to a terminal block 24 mounted suitably within the housing and attached to the rear channel member. The screws and electrical couplings therefore are contained within the enclosure and thus are not accessible for removal of the whole device without proper authorized access to the interior of the enclosure.

Figure 4:
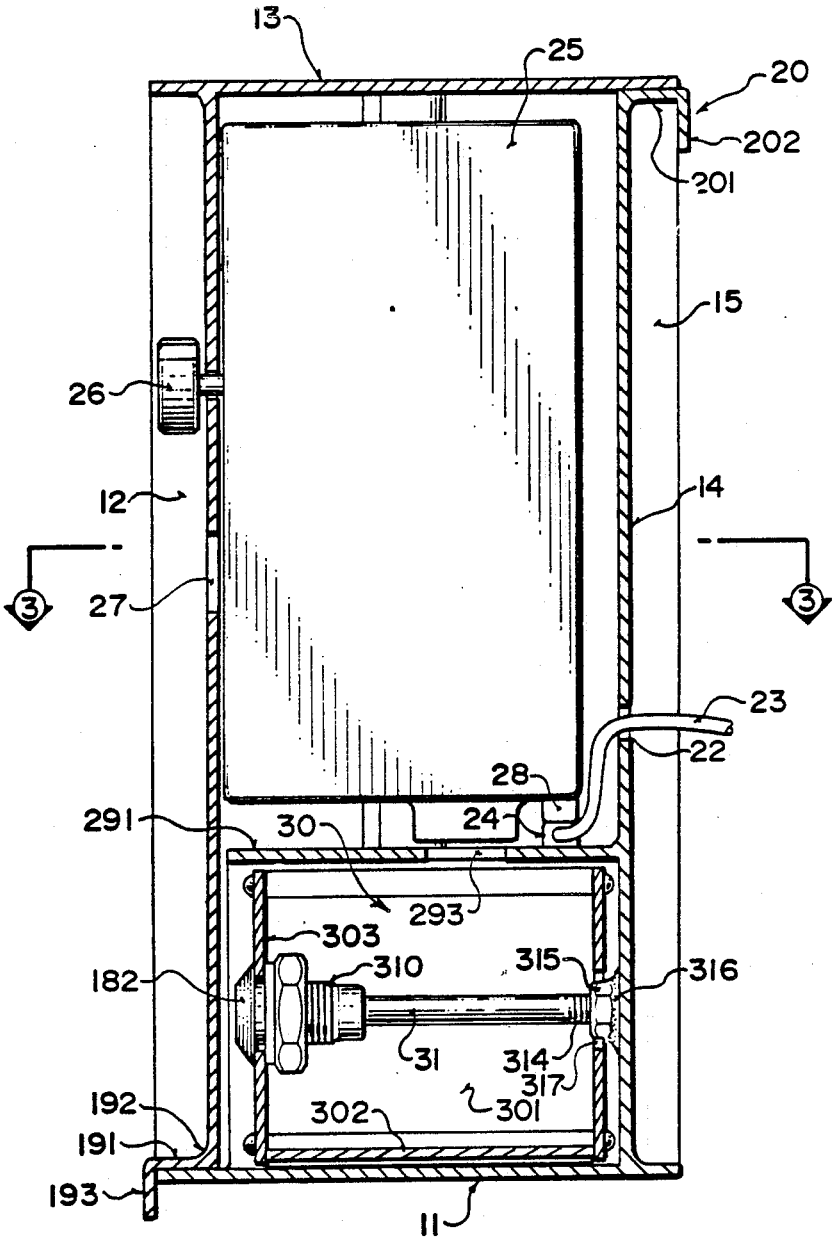
FIG. 4 is a cross-sectional view along the lines 4—4 of FIG. 3.
Figure 7:
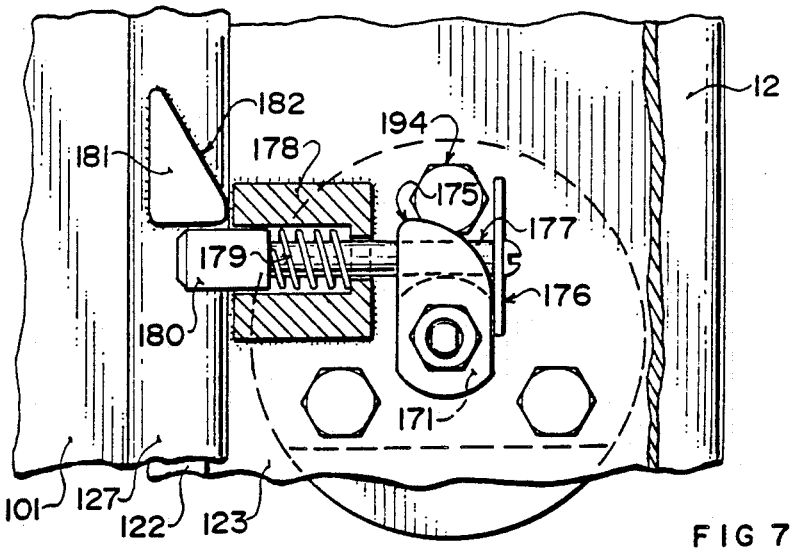
FIG. 7 is a rear elevational view of the lock mechanism of FIG. 6.
Figure 6:
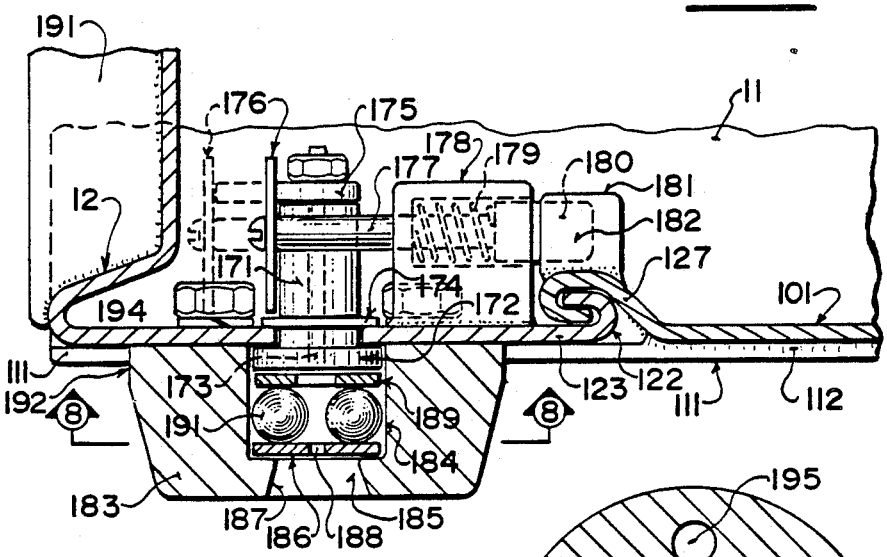
FIG. 6 is a cross sectional view of the container of FIG. 1 showing the details of the lock mechanism on an enlarged scale.

As shown best in FIG. 4, the front channel member carries a suitable coin freed actuating mechanism schematically indicated at 25. The details of the actuating mechanism will not be discussed herein in detail since they are not significant to the present invention and since they are of a conventional nature. It is suffice to say that the actuating mechanism includes a suitable dial arrangement 26 on the base panel of the front channel member which can be manually operated for actuation by the user. A coin slot 27 is in addition provided in the base panel for presentation of the suitable coins into the actuating mechanism 25. The actuating mechanism also includes a terminal block 28 which cooperates with the terminal block 24 so that the longitudinal movement of the front channel member causes the terminal blocks to enter and engage and provide the necessary electrical coupling between the incoming wire 23 and the mechanism 25.

A lower most portion of the enclosure comprises a money compartment 29. The money compartment 29 is attached to the rear channel member and to the lower end cap 11. Specifically the money compartment comprises an inverted C-channel including a horizontal plate 291 which is welded at its rear edge to the base panel 14 of the rear channel member. The size of the panel 291 is such that it just clears at its sides the inner most parts of the interlocking devices of the side walls. The rear edge is, as previously explained, welded to the inside face of the rear base panel. The front edge of the plate 291 is arranged so that it just clears the inner face of the front base panel. The C-channel includes integrally a pair of depending side plates 292 and 293 which extend downwardly therefrom to the lower end cap 11 to which they are welded along their lower most edges to form a rectangular closed compartment between the plate 291 and the lower end cap 11.

A drawer is positioned within the compartment 29 and indicated at 30. The drawer is formed by a horizontal base 301 and upstanding sides 302 which are formed as an integral extrusion in the form of a rectangular channel. A front face 303 is secured to the side 302 at portions. A similar construction is provided for a rear face of the drawer indicated at 305. To allow escape of any moisture from the drawer, openings are formed at the corners rearwardly of the end face.

Figure 5:
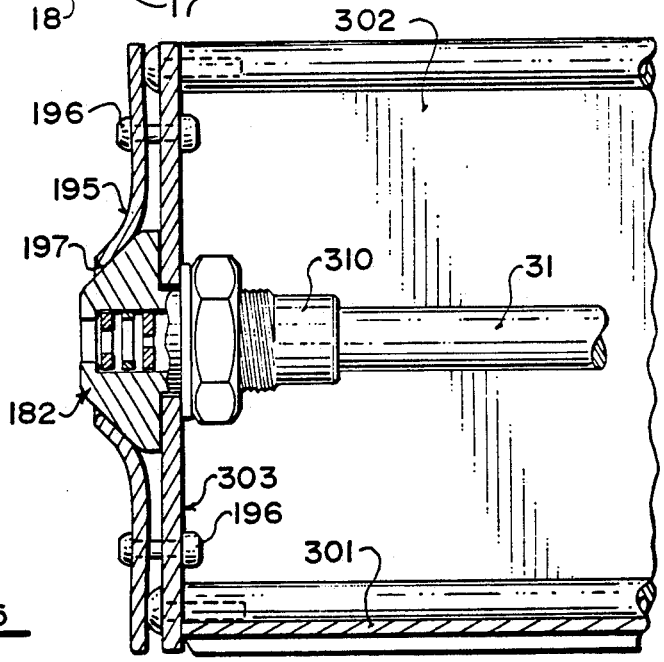
FIG. 5 is a cross sectional view showing only the drawer and lock mechanism therefor.

A locking mechanism for locking the drawer in position within the compartment 29 is shown in FIGS. 2 and 4 and in more detail in FIG. 5. The lock comprises a shaft 31 which can be rotated only by a key presented through an opening 311 in the front face 301. The opening 311 is provided centrally of a raised portion 312 which houses the lock mechanism 313 shown again schematically in FIGS. 2 and 4. The shaft 31 has on a rear end thereof a screw thread 314 for cooperating with a nut 315 which is welded at 316 to the rear base panel 14. An opening 317 in the rear face of the drawer allows the nut 315 to project therethrough into the drawer for engagement with the threaded shaft 31.

The lock of the drawer also includes a lock guard mechanism as described in relation to the lock 17. In this case the collar 182 of the lockguard device is held in place by a plate 195 which covers the front of the drawer 303 and is attached thereto by heavy rivets 196. A lip on the plate indicated at 197 extends outwardly and around the outer surface of the collar 182 to help retain it in position. The lock guard includes the plates as previously described which operate to control access to the barrel of the lock indicated 310 which is of the type which allows rotation of the barrel when the key is inserted so as to drive the shaft 31 as previously described. However in this case the balls are replaced by an intermediate plate which has a slot similar to the slots in the front and back plates.

The compartment 29 has a money slot 293 in the upper plate 291 for receiving money passing through the actuation mechanism 25.

The money can be extracted and collected from the compartment 29 by an authorized user having the necessary keys to operate the locking mechanism 17. When actuated and the pins removed, the front channel member can be lifted by a distance just sufficient to expose the front face of the drawer following which the authorized key can be used to unscrew the shaft 31 and remove the drawer for extraction of the collected money.

If required for service, the front channel member can be further moved longitudinally and removed simply when the interlocking u-shapes have moved to a position where they are no longer longitudinally interconnected. The actuating mechanism 25 is thus accessible for service and if required for replacement simply by moving into position an alternative front channel member including the replacement actuation mechanism 25. The mechanism 25 simply engages into its electrical connection by interconnection of the terminal blocks 24 and 28.

A service engineer can be supplied merely with the necessary key for actuation of the lock mechanism 17 so that he can gain access to the front channel member and the actuation mechanism 25. However the compartment 29 remains locked so that he cannot be tempted to remove a handful of coins.

The housing forming the outer surface of the security container is therefore very simply formed from two substantially identical halves defined by the channel members and associated end caps. The simple construction is formed by bending and welding techniques and is therefore an inexpensive construction. However the simple construction also removes or reduces to a minimum any access points by which the potential thief can attempt to gain entry by leverage or cutting.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A lock mechanism comprising a lock actuating device, a lock member engageable by an elongate blade of a key, said lock member having a slot-shaped front opening for movement along an axis into the lock member of the blade of the key when pressed through said front opening, said key blade being shaped to have one dimension transverse to its length longer than a dimension at right angles thereto so that it can pass through the slot-shaped front opening, said member and key being arranged such that a matching key can be rotated to move the lock actuating device, and a security cover device for covering the front opening, said security cover device comprising a collar member surrounding said front opening and defining a cover opening forward of and axially aligned with said front opening, a cylindrical wall extending from said cover opening to said front opening, and lip means on said cylindrical wall at said cover opening, said cylindrical wall having a circular cylindrical inner surface surrounding said axis, a front plate member received within the cylindrical wall generally at right angles to the axis and free to rotate within the cylindrical wall about the axis, said front plate member having a slot-shaped opening therein for the key, said lip means confining the front plate member within the cylindrical wall against axial movement out of the cylinder a back plate member received within the cylinder generally parallel to the front plate member and free to rotate within cover device, and at least three rigid spherical balls separately and freely mounted in an area defined rearwardly of the front plate and inwardly of the cylindrical surface, each ball being free to move radially within the confines of the cylindrical surface, to rotate around said axis and to rotate around its own center, the balls being dimensioned relative to the cylindrical surface such that, when the balls are moved in an outward direction to a parted position sufficient to just allow the blade of the key to pass through a slot shaped opening closely defined between the balls, the balls are restrained from further movement in the outward direction by contacting the cylindrical surface.

2. The invention according to claim 1 wherein said means in the space comprises at least three rigid balls arranged in a regular pattern around the periphery of the cylinder and spaced and dimensioned such that they are maintained in that pattern within the cylinder by the front plate and the cylinder and such that the balls can be parted sufficiently to allow the blade of the key to pass through a slot shaped opening closely defined between the balls to the front opening of the lock member.

3. The invention according to claim 1 wherein there are four balls within the cylindrical wall.

4. The invention according to claim 1 wherein said collar member is separate from the lock member and includes a plurality of blind holes surrounding the cylindrical wall which are screw threaded whereby the collar member can be bolted to a surface containing the lock member.

5. The invention according to claim 1 wherein the security cover device includes a back plate member within the cylindrical wall generally parallel to the front plate member and free to rotate within the cylindrical wall and having a slot shaped opening therein, the balls being received between the front plate member and the back plate member.

6. A lock mechanism comprising a lock actuating device, a lock member engageable by an elongate blade of a key, said lock member having a slot-shaped front opening for movement along an axis into the lock member of the blade of the key when pressed through said front opening, said key blade being shaped to have one dimension transverse to its length longer than a dimension at right angles thereto so that it can pass through the slot-shaped front opening, said member and key being arranged such that a matching key can be rotated to move said lock actuating device, and a security cover device for covering and surrounding said front opening of said lock member, said security cover device comprising a collar member surrounding said front opening, said collar member including means thereon for attachment of the collar member to a surface surrounding the lock member such that the collar member is separable from the lock member, said collar member defining a cover opening forwardly of and axially aligned with said front opening, a cylindrical wall extending from said cover opening to said front opening and lip means on said cylindrical wall at said cover opening, said cylindrical wall having a circular cylindrical inner surface surrounding said axis, a front plate member received within the cylindrical wall generally at right angles to the axis and free to rotate within the cylindrical wall about the axis, said front plate member having a slot-shaped opening therein for the key, lip means on the cylindrical wall at said cover opening confining the plate member within the cylindrical wall against axial movement out of the cover device, and at least three rigid spherical balls separately and freely mounted in an area defined rearwardly of the front plate and inwardly of the cylindrical surface, each ball being free to move radially within the confines of the cylindrical surface to rotate around said axis and to rotate around its own center, the balls being dimensioned relative to the cylindrical surface such that, when the balls are moved in an outward direction to a parted position sufficient to just allow the blade of the key to pass through a slot-shaped opening closely defined between the balls, the balls are restrained from further movement in the outward direction by contacting the cylindrical surface.

7. The invention according to claim 6 wherein there are four balls within the cylindrical wall.

8. The invention according to claim 6 wherein said collar member includes a plurality of blind holes surrounding the cylindrical wall which are screw threaded whereby the collar member can be bolted to a surface containing the lock member.

9. The invention according to claim 6 wherein the security cover device includes a back plate member within the cylindrical wall generally parallel to the front plate member and free to rotate within the cylindrical wall and having a slot shaped opening therein, the balls being received between the front plate member and the back plate member.

* * * * *